United States Patent [19]

Krüger

[11] 4,319,548

[45] Mar. 16, 1982

[54] INTERNAL-COMBUSTION ENGINE HAVING TWO ROWS OF CYLINDERS

[75] Inventor: Hermann Krüger, Wolfsburg, Fed. Rep. of Germany

[73] Assignee: Volkswagenwerk Aktiengesellschaft, Wolfsburg, Fed. Rep. of Germany

[21] Appl. No.: 62,515

[22] Filed: Jul. 30, 1979

[30] Foreign Application Priority Data

Aug. 23, 1978 [DE] Fed. Rep. of Germany ..... 2836833

[51] Int. Cl.[3] ..... F01L 1/04

[52] U.S. Cl. ..... 123/90.27; 123/55 R; 123/90.52

[58] Field of Search ..... 123/90.27, 90.55, 55 R, 123/55 VE, 55 VF, 55 VS, 52 MV, 90.52, 90.48

[56] References Cited

U.S. PATENT DOCUMENTS

| | | | |
|---|---|---|---|
| 1,044,198 | 11/1912 | Lavoie | 123/55 R |
| 1,173,105 | 2/1916 | Fekete | 123/55 V |
| 1,202,741 | 10/1916 | Landgraf | 123/90.27 |
| 1,325,765 | 12/1919 | Thomas | 123/55 VS |
| 1,722,950 | 7/1929 | Barkeij | 123/55 VS |
| 1,910,813 | 5/1933 | Powell | 123/90.27 |
| 3,521,613 | 7/1970 | Celli | 123/90.27 |
| 3,704,696 | 12/1972 | Abell, Jr. | 123/90.55 |
| 4,194,469 | 3/1980 | Kruger | 123/55 VS |

*Primary Examiner*—Craig R. Feinberg
*Assistant Examiner*—W. R. Wolfe
*Attorney, Agent, or Firm*—Spencer & Kaye

[57] ABSTRACT

In an internal combustion engine including a plurality of cylinders arranged in two rows extending in the longitudinal direction of the engine at opposite sides of a longitudinal center plane of the engine, inlet and outlet valves arranged in two rows and having longitudinal axes which extend obliquely to the longitudinal center plane of the engine, and a common camshaft operatively associated with the valves and having a longitudinal axis disposed at least approximately in the longitudinal center plane of the engine, the valves are disposed and oriented in a manner such that the longitudinal axes of the valves at least approximately intersect the longitudinal axis of the camshaft, and the valves are constructed and positioned to be directly actuated by the camshaft.

3 Claims, 1 Drawing Figure

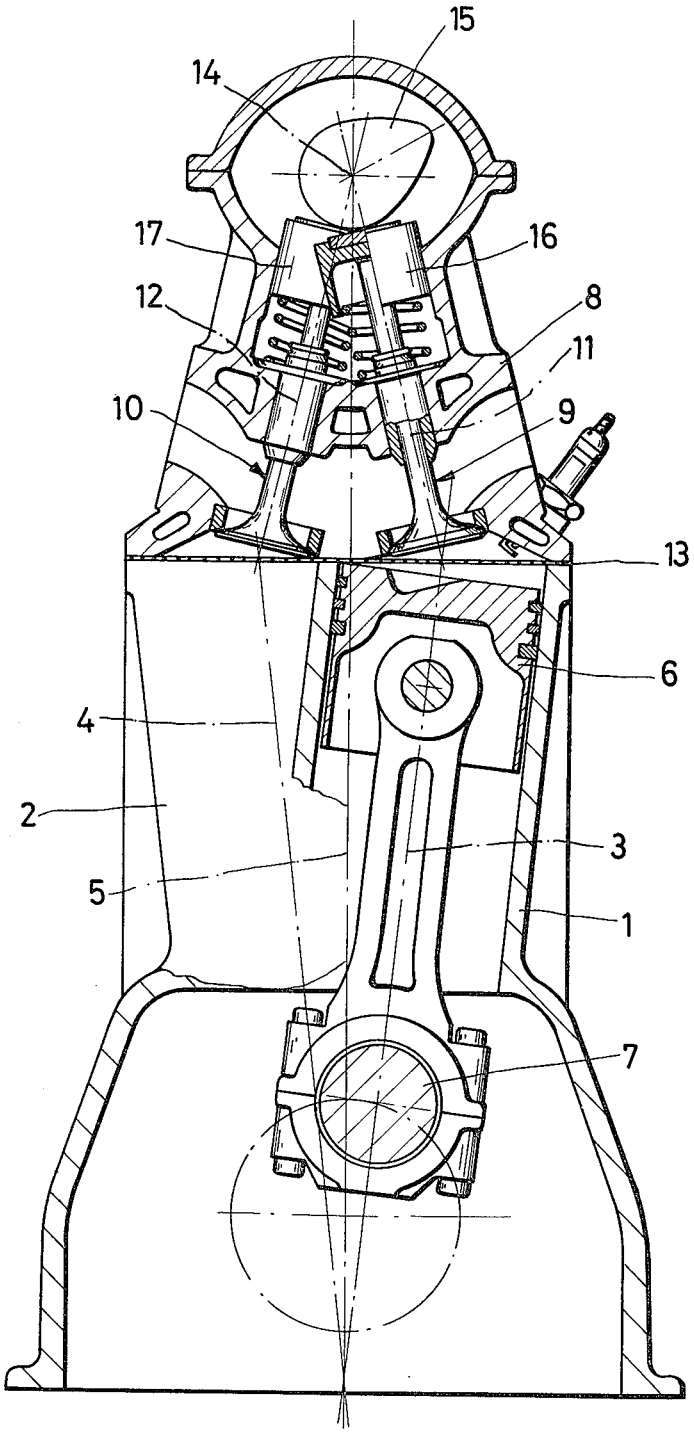
15
14
17
16
12
8
11
10
9
13
6
4
2
3
5
1
7

INTERNAL-COMBUSTION ENGINE HAVING TWO ROWS OF CYLINDERS

BACKGROUND OF THE INVENTION

The present invention relates to an internal combustion engine of the type including a plurality of cylinders arranged in two rows extending in the longitudinal direction of the engine at opposite sides of a longitudinal center plane of the engine, inlet and outlet valves arranged in two rows and having longitudinal axes which extend obliquely to the longitudinal center plane of the engine, and a common camshaft operatively associated with the valves and having a longitudinal axis disposed at least approximately in the longitudinal center plane of the engine.

In an engine of this type, one example of which is disclosed in Bussien, "Automobiltechnisches Handbuch" [Handbook of Automotive Engineering] 17th Edition (1953), Volume 2, at pages 48 and 94, the cylinders are arranged in a V pattern so that each one of the two rows of cylinders forms one arm of the V. In principle it is also possible, however, to arrange the cylinders in two rows with their longitudinal axes parallel to one another and the cylinders laterally offset with respect to one another.

This structural principle offers the advantageous possibility of creating a short engine which is also relatively narrow. Another advantage of such a structure is that the engine requires only one camshaft to control all valves. In addition, this structure makes it possible to provide a common cylinder head for all cylinders.

In known internal combustion engines the spacing between the valves associated with cylinders in different cylinder rows, measured transversely to the length of the engine, the length being in the direction of the crank shaft axis, is relatively large so that additional pivot levers are placed between the camshaft and the valves to transmit the actuating forces.

SUMMARY OF THE INVENTION

It is an object of the present invention to significantly simplify the structure of the valve drive of an internal combustion engine of the above-mentioned type, in a manner which also leads to simplification of the structure of the cylinder head.

These and other objects are achieved, according to the invention, in an internal combustion engine including a plurality of cylinders arranged in two rows extending in the longitudinal direction of the engine at opposite sides of a longitudinal center plane of the engine, inlet and outlet valves arranged in two rows and having longitudinal axes which extend obliquely to the longitudinal center plane of the engine, and a common camshaft operatively associated with the valves and having a longitudinal axis disposed at least approximately in the longitudinal center plane of the engine, by disposing and orienting the valves in a manner such that the longitudinal axes of the valves at least approximately intersect the longitudinal axis of the camshaft, and the valves are directly actuated by the camshaft.

Briefly stated, the present invention can be defined as providing a V-design for the valve array with the tip of the V coinciding at least approximately with the longitudinal axis of the common camshaft. Without adversely influencing important parameters, such as valve travel, this permits attainment of a camshaft and valve housing which has comparatively small dimensions both vertically and transversely.

BRIEF DESCRIPTION OF THE DRAWING

The sole FIGURE is an elevational, cross-sectional view of a vehicle internal combustion engine constructed according to a preferred embodiment of the invention.

DESCRIPTION OF THE PREFERRED EMBODIMENTS

The engine shown in the FIGURE is provided with two rows of cylinders, 1 and 2, each row extending perpendicularly to the plane of the FIGURE. The longitudinal axes 3 and 4, respectively, of the cylinders 1 and 2 belonging to different rows of cylinders enclose acute angles with the longitudinal, vertical center plane 5 of the internal combustion engine.

In a conventional manner, pistons, of which only the piston 6 of cylinder 1 is shown, move in the cylinders and drive a common crankshaft 7.

All cylinders are associated with a common cylinder head 8 provided with fuel mixture intake and exhaust outlet channels as well as conduits for the respective valves, of which only the valve 9 associated with cylinder 1 and the valve 10 associated with cylinder 2 are visible in the drawing. The longitudinal axes 11 and 12 of valves 9 and 10, respectively are also arranged in a V pattern in such a manner that, on the one hand, they intersect the longitudinal axes 3 and 4 of cylinders 1 and 2 at the level of the cylinder head gasket 13 and, on the other hand, they have a common point of intersection substantially on the axis 14 of the common camshaft 15. Each of valves 9 and 10 has an associated bucket tappet 16 or 17 driven directly by the camshaft 15, that is without the intermediary of additional levers. The structure of such bucket tappets is known per se and is disclosed, for example, in U.S. Pat No. 3,704,696, so that their configuration will not be described in detail.

The use of bucket tappets within the scope of the present invention offers the advantage, in addition to low noise development, of a particularly simple structure for the cylinder head 8 even under consideration of the fact that the transverse forces exerted on the bucket tappets 16 and 17 as a result of rotary movement of the camshaft 15 must be absorbed by the housing 8.

Due to the V design of the valve arrangement as well as of the cylinder arrangement, the longitudinal axes of the valves and cylinders form a rhomboid quadrangle in the illustrated sectional view. It can easily be seen that this design results in a particularly narrow structure as well as a low structural height.

It is to be understood that the above description of the present invention is susceptible to various modifications, changes and adaptations, and the same are intended to be comprehended within the meaning and range of equivalents of the appended claims.

What is claimed is:

1. In an internal combustion engine including a single cylinder head, a plurality of cylinders all associated with the single cylinder head and arranged in two rows extending in the longitudinal direction of the engine with the axes of the cylinders of the two rows at respectively opposite sides of a longitudinal center plane of the engine, inlet and outlet valves arranged in two rows with each row of valves being associated with a respective row of cylinders and each valve having a longitudinal axis which extends obliquely to the longitudinal center plane of the engine, and a common camshaft carried by the single cylinder head, operatively associated with the valves and having a longitudinal axis disposed at least approximately in the longitudinal center plane of the engine, the improvement wherein: said valves are disposed and oriented in a manner such that the longitudinal axes of said valves substantially intersect the longitudinal axis of said camshaft; the longitudinal axes of said valves in one row lie in a first common plane, the longitudinal axes of said valves in the other row lie in a second common plane and the first and second common planes form an acute angle opening toward said cylinders and having its apex substantially at the longitudinal axis of said camshaft; each said common plane forms an obtuse angle with the axes of said cylinders of its associated row of cylinders; and said valves are constructed and positioned for being directly actuated by said camshaft.

2. An engine as defined in claim 1 wherein each said valve comprises a bucket tappet.

3. An engine as defined in claim 1 or 2 wherein the longitudinal axes of said valves and the longitudinal axes of said cylinders lie in planes which form a rhomboid quadrangle with a plane perpendicular to the longitudinal direction of said engine.

* * * * *